US009878876B2

(12) United States Patent
Wilke et al.

(10) Patent No.: US 9,878,876 B2
(45) Date of Patent: Jan. 30, 2018

(54) ELEVATOR DEMAND ENTERING DEVICE

(71) Applicant: OTIS ELEVATOR COMPANY, Farmington, CT (US)

(72) Inventors: Michael Wilke, Berlin (DE); Donald F. Cominelli, Berlin (DE); Hans-Kilian Spielbauer, Berlin (DE); Michael Peters, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 378 days.

(21) Appl. No.: 14/432,568

(22) PCT Filed: Oct. 3, 2012

(86) PCT No.: PCT/US2012/058523

§ 371 (c)(1),
(2) Date: Mar. 31, 2015

(87) PCT Pub. No.: WO2014/055070

PCT Pub. Date: Apr. 10, 2014

(65) Prior Publication Data

US 2015/0274486 A1 Oct. 1, 2015

(51) Int. Cl.

| | |
|---|---|
| ***B66B 1/20*** | (2006.01) |
| ***B66B 5/00*** | (2006.01) |
| ***B66B 1/46*** | (2006.01) |

(52) U.S. Cl.

CPC ..... *B66B 5/0018* (2013.01); *B66B 1/466* (2013.01); *B66B 5/0025* (2013.01)

(58) Field of Classification Search

CPC ..... B66B 5/0018; B66B 1/466; B66B 5/0025
USPC ..... 187/384
See application file for complete search history.

(56) References Cited

U.S. PATENT DOCUMENTS

| | | | | |
|---|---|---|---|---|
| 4,044,860 | A | 8/1977 | Kaneko et al. | |
| 5,435,416 | A | 7/1995 | Siikonen et al. | |
| 5,616,896 | A * | 4/1997 | Kontturi | B66B 1/2458 187/382 |
| 5,679,934 | A | 10/1997 | Juntunen et al. | |
| 7,073,633 | B2 | 7/2006 | Weinberger et al. | |
| 7,500,544 | B2 | 3/2009 | Hakala et al. | |
| 7,513,337 | B2 | 4/2009 | Siikonen et al. | |

(Continued)

FOREIGN PATENT DOCUMENTS

| | | |
|---|---|---|
| JP | 2004161433 A | 6/2004 |
| JP | 2006182533 A | 7/2006 |

(Continued)

OTHER PUBLICATIONS

EP2903923 search opinion, dated Jul. 14, 2016.*
PCT/US2012/058523 search opinion, dated Apr. 23, 2013.*
European Search Report for application EP 12886091.3, dated Jul. 14, 2016, 10 pages.
International Search Report of application PCT/US2012/058523, dated Apr. 23, 2013, 5 pages.

(Continued)

*Primary Examiner* — Jeffrey Donels
(74) *Attorney, Agent, or Firm* — Cantor Colburn LLP

(57) ABSTRACT

Embodiments are directed to receiving, by a demand entering device configured to receive an elevator destination command, a request for at least one of: statistical data regarding use of at least one elevator, and field data in connection with a field service, maintenance, repair, or installation activity associated with the at least one elevator, and obtaining, by the demand entering device, at least one of the statistical data and the field data in response to the request.

18 Claims, 2 Drawing Sheets

(56) References Cited

U.S. PATENT DOCUMENTS

| | | | | |
|---|---|---|---|---|
| 7,823,700 | B2 * | 11/2010 | Boss | B66B 1/468 187/247 |
| 8,813,917 | B2 * | 8/2014 | Salmikuukka | B66B 1/468 187/247 |
| 8,905,195 | B2 * | 12/2014 | Finschi | B66B 1/2458 187/249 |
| 9,517,917 | B2 * | 12/2016 | Tokura | B66B 1/2458 |
| 9,580,274 | B2 * | 2/2017 | Nowel | F24F 11/0009 |
| 2003/0192746 | A1 | 10/2003 | Suzuki | |
| 2007/0012521 | A1 * | 1/2007 | Sakai | B66B 1/30 187/380 |
| 2008/0264731 | A1 | 10/2008 | Mangini et al. | |
| 2009/0294221 | A1 | 12/2009 | Bahjat et al. | |
| 2012/0090922 | A1 | 4/2012 | Elomaa et al. | |

FOREIGN PATENT DOCUMENTS

| | | | |
|---|---|---|---|
| JP | 2007067848 | A | 3/2007 |
| JP | 2009167004 | A | 7/2009 |
| KR | 100948360 | B1 | 3/2010 |

OTHER PUBLICATIONS

Lobby PC, "A Fast, Proven Way to Increase Guest Satisfaction & Set Your Property Apart", iBAHN Inc., http://www.ibahn.com/en-us/public/docs/LobbyPC_Product_Sheet.pdf, 2009, 1 page.

Written Opinion of application PCT/US2012/058523, dated Apr. 23, 2013, 5 pages.

* cited by examiner

ELEVATOR DEMAND ENTERING DEVICE

BACKGROUND

In order to collect data (e.g., statistical data) in an elevator environment, an elevator management system or a building automation system is used. These systems include hardware like personal computers, workstations, embedded hardware and communication cabling. Often local area network (LAN) hardware for the workstations is also needed, such as firewalls, routers, switches, etc. All of these additional devices/entities represent a cost to an elevator operator or customer in terms of obtaining data from the elevator groups.

To provide support for the elevator, a field operator, a technician, or other maintenance personnel may obtain access to the elevator via an elevator controller (e.g., an embedded elevator controller). The elevator controller may be located in a machine room at the top or bottom of a building in which the elevator is located. Alternatively, the elevator controller may be located in the hall of the top floor or in the elevator shaft, where gaining physical access may pose a security issue. In order to access the elevator controller, the maintenance personnel uses additional hardware, such as notebook computers, service tools, handheld tools, cables, and measurement equipment.

BRIEF SUMMARY

An embodiment of the disclosure is directed to an elevator system comprising a demand entering device configured to receive an elevator destination command and to provide statistical data regarding use of at least one elevator.

An embodiment of the disclosure is directed to a method comprising receiving, by a demand entering device configured to receive an elevator destination command, a request for at least one of: statistical data regarding use of at least one elevator, and field data in connection with a field service, maintenance, repair, or installation activity associated with the at least one elevator, and obtaining, by the demand entering device, at least one of the statistical data and the field data in response to the request.

An embodiment of the disclosure is directed to an apparatus comprising at least one processor, and memory having instructions stored thereon that, when executed by the at least one processor, cause the apparatus to receive an elevator destination command pertaining to a plurality of elevators, and receive a request for at least one of: statistical data regarding use of at least one elevator included in the plurality of elevators, and field data in connection with a field service, maintenance, repair, or installation activity associated with at least one elevator included in the plurality of elevators.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
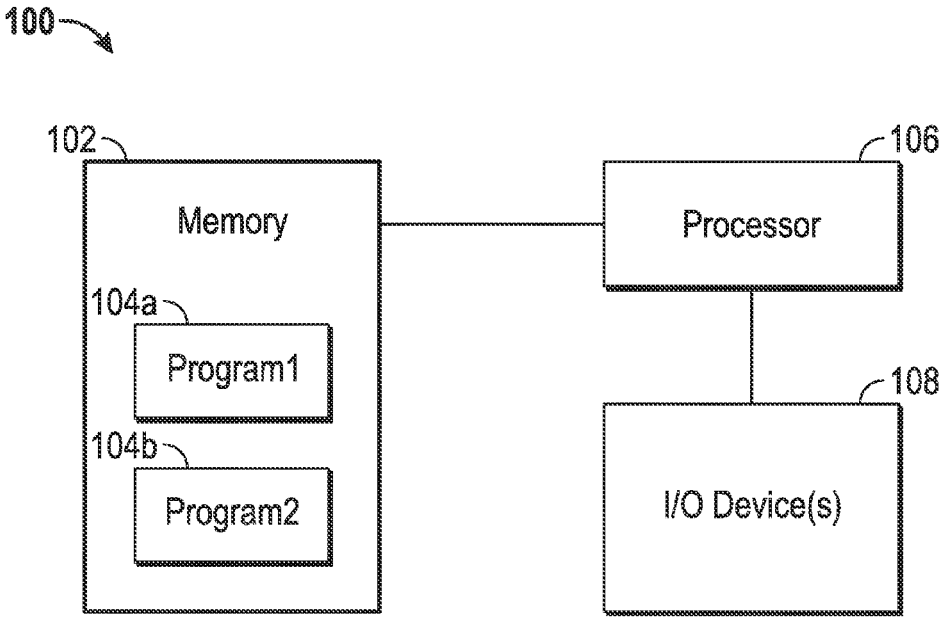
FIG. 1 is a schematic block diagram illustrating an exemplary computing system in accordance with one or more aspects of this disclosure.

Exemplary embodiments of apparatuses, systems, and methods are described for accessing data associated with one or more elevators. In some embodiments, the data may include statistical data associated with use of the elevators. The statistical data may be used by an elevator operator or customer to maximize efficiency or use of the elevators or to obtain insight into the operation of the elevators. In some embodiments, the data may include field data. The field data may be used by a field operator, a technician, or other maintenance personnel to maintain, service, repair, or install components on the elevators. In some embodiments, the data may be accessed from one or more devices, such as a demand entering device.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Referring to FIG. 1, an exemplary computing system 100 is shown. The system 100 is shown as including a memory 102. The memory 102 may store executable instructions. The executable instructions may be stored or organized in any manner and at any level of abstraction, such as in connection with one or more processes, routines, methods, etc. As an example, at least a portion of the instructions are shown in FIG. 1 as being associated with a first program 104*a* and a second program 104*b*.

The instructions stored in the memory 102 may be executed by one or more processors, such as a processor 106. The processor 106 may be coupled to one or more input/output (I/O) devices 108. In some embodiments, the I/O device(s) 108 may include one or more of a keyboard or keypad, a touchscreen or touch panel, a display screen, a microphone, a speaker, a mouse, a button, a remote control, a joystick, a printer, etc. The I/O device(s) 108 may be configured to provide an interface to allow a user to interact with the system 100.

The system 100 is illustrative. In some embodiments, one or more of the entities may be optional. In some embodiments, additional entities not shown may be included. For example, in some embodiments the system 100 may be associated with one or more networks. In some embodiments, the entities may be arranged or organized in a manner different from what is shown in FIG. 1. One or more of the entities shown in FIG. 1 may be associated with one or more of the devices or entities described herein.

Figure 2:
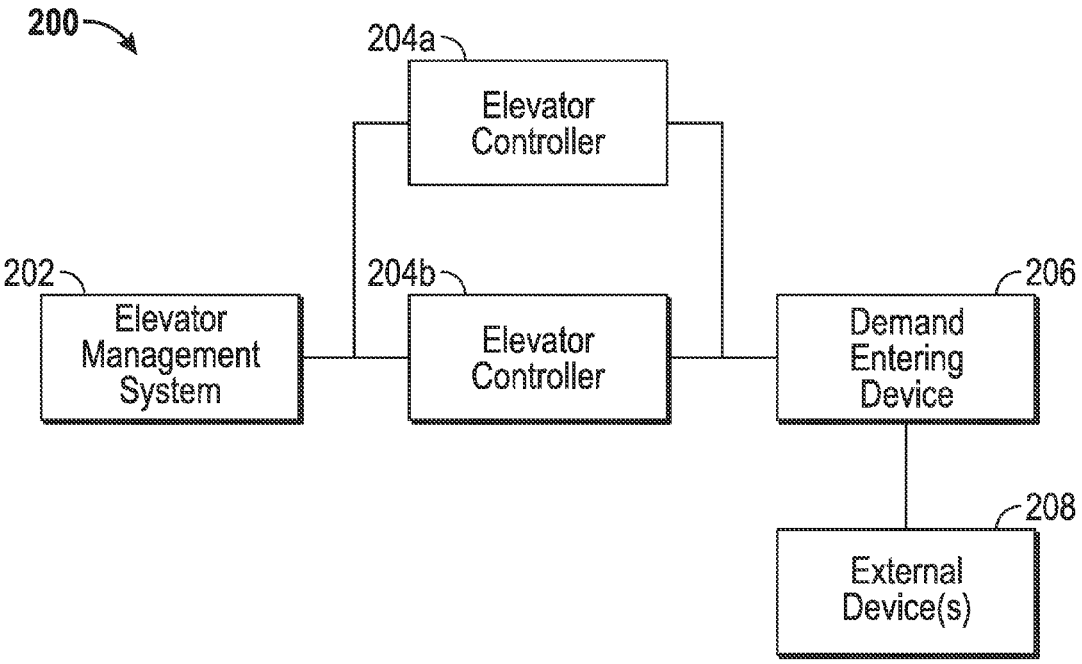
FIG. 2 illustrates an exemplary system architecture in accordance with one or more embodiments of the disclosure.

FIG. 2 illustrates a system architecture 200 in an exemplary embodiment. The architecture 200 may be included as a part of an elevator or elevator system. The architecture 200 may be used to obtain access to controls or data as described herein.

The architecture 200 may include one or more elevator management systems, such as an elevator management system 202. The elevator management system 202 may be associated with one or more elevators. For example, the elevator management system 202 may provide for a management or monitoring function with respect to a cluster, a bank, or a group of elevators. The elevator management system 202 may provide for a secure landing.

The elevator management system 202 may collect or aggregate data, such as statistical data. The statistical data may be indicative of use of the elevator(s) coupled to the elevator management system. For example, the statistical data may include one or more of: passenger waiting time (up, down, and total), passenger in-car time, passenger time to destination (service time), records about target landings served from one or more other landings, number of passengers served, passenger identification (ID) and/or company ID traveled from a source landing X to a target landing Y, energy or power utilization, etc.

The architecture 200 may include one or more elevator controllers, such as elevator controllers 204*a* and 204*b*. Each of the elevator controllers 204 may be associated with an elevator. For example, the elevator controller 204*a* may be associated with a first elevator, and the elevator controller 204*b* may be associated with a second elevator, where the first and second elevators may be monitored or managed by the elevator management system 202. While two elevator controllers 204*a* and 204*b* are shown in FIG. 2, a system may include more or less than two elevators.

An elevator controller 204 (e.g., the elevator controller 204*a*) may collect or aggregate data, such as field data. The field data may be used in connection with field service, maintenance, repair, or installation activities. In some embodiments, the field data may include one or more of: elevator door times per floor, elevator event logs and traces, elevator error logs and traces, elevator installation setup, elevator feature setup, elevator status monitoring, handling of passenger rescue operations, elevator blockage reason(s), elevator I/O monitoring, elevator maintenance command entry (e.g., clear event/errors, reset system, etc.), invoking handover tests, trapped passenger release notification, energy or power utilization, etc.

The architecture 200 may include one or more demand entering devices, such as a demand entering device 206. The demand entering device 206 may be embodied or implemented as a kiosk, potentially using exemplary computing system 100. The demand entering device 206 may provide for an I/O interface (e.g., I/O devices 108 of FIG. 1). The demand entering device 206 may provide an interface to enable a user (e.g., an end-user) to enter a destination command to one or more elevator groups. For example, the user in a lobby on the ground floor of an office building may indicate to the demand entering device 206 that the user wants to go to the fourteenth floor of the office building, which may coincide with her place of employment. Based on the provided indication, one or more devices (e.g., an elevator management system, an elevator controller, etc.) may provide the requested service to the user.

In some embodiments, in addition to receiving an entered destination command, the demand entering device 206 may provide access to data collected by the architecture 200. For example, the demand entering device 206 may provide access to statistical data and/or field data. In some embodiments, the demand entering device 206 may store the data. In some embodiments, the demand entering device 206 might not store the data, but may request the data from another device or entity (e.g., the elevator management system 202, the elevator controller 204*a*, the elevator controller 204*b*, etc.) upon request.

The data associated with the architecture 200 may be organized or arranged at any level of abstraction and in any manner. For example, the data may be organized based on a particular elevator or group of elevators, identification of an employee or company using the elevator, etc. In some embodiments, the data may be presented in accordance with a chat, a graph, a table, or the like.

In some embodiments, the data may be accessed by one or more devices external to the elevator system, such as external device(s) 208. External device(s) 208 may be implemented using exemplary computing system 100. The external device(s) 208 may include one or more of a server, a laptop computer, a notebook computer, a personal computer, a mobile device (e.g., a cell phone or a smart phone), etc. In some embodiments, the external device(s) 208 may include a remote monitoring site or a remotely located device.

The external device(s) 208 may communicate with one or more entities, such as the demand entering device 206, to obtain the data. The communication may adhere to one or more communication types, protocols, or standards. For example, WLAN, Bluetooth, Ethernet, or serial communications may be used in some embodiments. More generally, a first device or entity may transmit data to, or receive data from, any other device or entity in accordance with any type, protocol, or standard of communication.

The architecture 200 is illustrative. In some embodiments, one or more additional entities not shown may be included. In some embodiments, the entities may be organized or arranged in a manner different from what is shown in FIG. 2.

In some embodiments, one or more of the entities described above with respect to the architecture 200 may be optional. For example, in some embodiments the elevator management system 202 might not exist. In such embodiments, the demand entering device 206 may count, generate, and/or show data, such as statistical data. In some embodiments, the demand entering device 206 may obtain the statistical data from another entity, such as an elevator controller 204. The demand entering device 206 may request the statistical data from the elevator controller 204.

In some embodiments, conditional access to one or more items of data may be provided. For example, access may be based on one or more factors, such as a user credential (e.g., a username and password, a PIN number or code, a security card, RFID tags, etc.), a location of a user, the time of day, the type of data requested, the type of device being used to access or request the data, etc. The level of access may also be conditioned. For example, based on the factors described above, a user may be able to view the data but might not be able to save the data. Conditional access to data may be used to ensure elevator security or safety.

Figure 3:
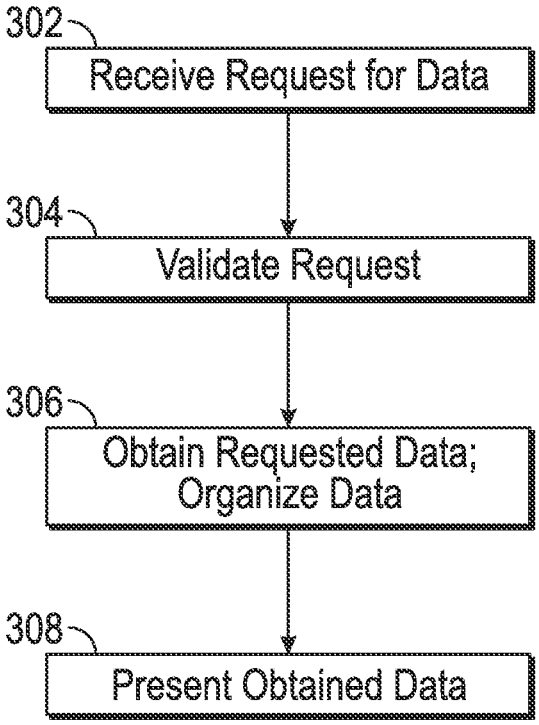
FIG. 3 illustrates an exemplary method of accessing data in accordance with one or more embodiments of the disclosure.

FIG. 3 illustrates a method that may be used in connection with one or more devices or systems, such as those described herein. The method of FIG. 3 may be used to access data at a device, such as the demand entering device 206 or the external device(s) 208.

In block 302, a request for data may be received. The request may specify the type of data that is requested (e.g., statistical data or field data). The request may include an identification of a user or a device/entity requesting the data.

In block 304, the request may be validated. For example, the identity of a user or device/entity may need to be validated before access to the requested data is granted. If the user or device/entity is not allowed to access the requested data, access to the data may be denied and the user may receive a notification (e.g., an email, a text message, a voice message, a report, etc.) that the access was denied, potentially in combination with the reason why access was denied. If the user or device/entity is allowed access to the requested data, flow may proceed to block 306.

In block 306, the requested data may be obtained. For example, if the request of block 302 originated on an external device 208, and the request pertained to statistical data, the statistical data may be obtained from, e.g., the elevator management system 202, the elevator controller 204*a* or 204*b*, and/or the demand entering device 206. Similarly, if the request pertained to field data, the field data may be obtained from, e.g., the elevator controller 204*a*, the elevator controller 204*b*, and/or the demand entering device 206. In some embodiments, the obtained data may be organized or arranged as part of block 306. For example, the obtained data may be organized as one or more charts, tables, graphs, etc.

In block 308, the obtained data may be presented. For example, one or more charts, tables, graphs, emails, text messages, reports, documents, etc., associated with the data may be displayed on a display screen. In some embodiments, an auditory message (e.g., a voice message) may be played in presenting the data.

The method illustrated in connection with FIG. 3 is illustrative. In some embodiments, one or more of the blocks or operations (or portions thereof) may be optional. In some embodiments, additional operations not shown may be included. In some embodiments, the operations may execute in an order or sequence different from what is shown.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Embodiments may be tied to one or more particular machines. For example, one or more devices or architectures may be configured to provide conditional access to one or more items of data, such as statistical data and field data. The data may be communicated in accordance with one or more communication types, protocols, or standards. The data may be presented using one or more formats.

Embodiments of the disclosure may provide for a collection, storage, handling, showing, and delivery of data. Embodiments of the disclosure may provide easy and beneficial access to data, such as statistical data and field data. Such access may be provided in connection with a demand entering device and/or one or more devices external to the elevator system. No additional resources, such as hardware and software, might be required. In some embodiments, a building owner (e.g., an office building owner) may use the data to generate elevator usage rates for tenants or customers (e.g., businesses or companies renting out floors in the building). In some embodiments, personnel (e.g., maintenance personnel) may use the data to perform service, maintenance, or installation activities.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. An elevator system comprising:

a demand entering device that:

receives an elevator destination command for at least one elevator via an interface of the demand entering device comprising at least one of a keyboard, a keypad, a touchscreen and a touch panel configured to receive the elevator destination command;

receives a request from a user, via the interface of the demand entering device, for:

statistical data regarding use of the at least one elevator, and field data in connection with a field service, maintenance, repair, or installation activity associated with the at least one elevator; and presents to the user, via the interface of the demand entering device, the statistical data and the field data.

2. The system of claim 1, wherein the statistical data comprises at least one of: company ID traveled from a source landing to a target landing, and energy or power utilization.

3. The system of claim 1, wherein the field data comprises at least one of: elevator door times per floor, elevator installation setup, elevator feature setup, handling of passenger rescue operations, elevator blockage reason(s), elevator invoking handover tests, trapped passenger release notification, and energy or power utilization.

4. The system of claim 1, wherein the demand entering device is configured to provide conditional access to at least one of the statistical data and the field data.

5. The system of claim 4, wherein the conditional access is based on a validation of at least one of: a user credential, a location of the user, a time of day, a type of data requested, and a type of device used to request data.

6. The system of claim 1, wherein the demand entering device is configured to organize at least one of the statistical data and the field data in accordance with at least one of a graph, a table, and a chart; and to provide the at least one of a graph, a table, and a chart via the interface of the demand entering device.

7. The system of claim 1, wherein the demand entering device is configured to communicate at least one of the statistical data and the field data to an external device.

8. The system of claim 7, wherein the external device comprises at least one of a server, a laptop computer, a notebook computer, a personal computer, and a mobile device.

9. The system of claim 7, wherein demand entering device is configured to communicate according to at least one of WLAN, Bluetooth, Ethernet, and serial communications.

10. A method comprising:

receiving, by an interface of a demand entering device, an elevator destination command, wherein the interface of the demand entering device comprises at least one of a keyboard, a keypad, a touchscreen and a touch panel configured to receive the elevator destination command;

receiving, by the interface of the demand entering, a request from a user for:

statistical data regarding use of at least one elevator, and field data in connection with a field service, maintenance, repair, or installation activity associated with the at least one elevator;

obtaining, by the demand entering device, the statistical data and the field data in response to the request; and presenting to the user, by the interface of the demand entering device, the statistical data and the field data.

11. The method of claim 10, wherein the request originates at the demand entering device.

12. The method of claim 10, wherein the request is received from a device external to an elevator system associated with the at least one elevator.

13. The method of claim 10, further comprising:

validating the request; and obtaining, by the demand entering device, at least one of the statistical data and the field data responsive to validating the request.

14. The method of claim 13, further comprising:

transmitting, by the demand entering device, at least one of the statistical data and the field data to a device external to an elevator system associated with the at least one elevator.

15. An apparatus comprising:

an interface comprising at least one of a keyboard, a keypad, a touchscreen and a touch panel configured to receive an elevator destination command pertaining to a plurality of elevators;

at least one processor; and memory having instructions stored thereon that, when executed by the at least one processor, cause the apparatus to:

receive, via the interface, the elevator destination command, and receive, via the interface, a request from a user for:

statistical data regarding use of at least one elevator included in the plurality of elevators, and field data in connection with a field service, maintenance, repair, or installation activity associated with at least one elevator included in the plurality of elevators; and present to the user, via the interface, the statistical data and the field data.

16. The apparatus of claim 15, wherein the instructions, when executed by the at least one processor, cause the apparatus to:

validate the request, determine that the request pertains to statistical data based on validation of the request, and obtain the statistical data from an elevator controller responsive to a determination that the request pertains to statistical data.

17. The apparatus of claim 15, wherein the instructions, when executed by the at least one processor, cause the apparatus to:

validate the request, determine that the request pertains to field data based on validation of the request, and obtain the field data from an elevator controller responsive to a determination that the request pertains to field data.

18. The apparatus of claim 15, wherein the instructions, when executed by at least one processor, cause the apparatus to:

validate the request, determine that the request pertains to statistical data based on validation of the request, and obtain the statistical data from the memory responsive to a determination that the request pertains to statistical data.

* * * * *